US010655931B2

(12) United States Patent
Yeates

(10) Patent No.: US 10,655,931 B2
(45) **Date of Patent: *May 19, 2020**

(54) HOLSTER WITH PUSHROD DISENGAGEMENT LOCKING ELEMENT

(71) Applicant: Sentry Solutions Products Group LLC, Virginia Beach, VA (US)

(72) Inventor: Eric M. Yeates, Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/209,824

(22) Filed: Dec. 4, 2018

(65) Prior Publication Data

US 2019/0120592 A1 Apr. 25, 2019

Related U.S. Application Data

(63) Continuation-in-part of application No. 15/683,590, filed on Aug. 22, 2017, now Pat. No. 10,145,649.

(60) Provisional application No. 62/378,648, filed on Aug. 23, 2016.

(51) Int. Cl.

| | |
|---|---|
| ***F41C 33/00*** | (2006.01) |
| ***F41C 33/02*** | (2006.01) |
| *F41C 33/04* | (2006.01) |

(52) U.S. Cl.

CPC ..... *F41C 33/0263* (2013.01); *F41C 33/0236* (2013.01); *F41C 33/0272* (2013.01); *F41C 33/0218* (2013.01); *F41C 33/04* (2013.01)

(58) Field of Classification Search

CPC .. F41C 33/04; F41C 33/0263; F41C 33/0272; F41C 33/0218; F41C 33/0236

USPC ..... 224/244

See application file for complete search history.

(56) References Cited

U.S. PATENT DOCUMENTS

| | | | |
|---|---|---|---|
| 3,866,811 | A | 2/1975 | Hamby |
| 3,910,469 | A | 10/1975 | Baldocchi |
| 4,971,236 | A | 11/1990 | Grummet |
| 5,573,157 | A | 11/1996 | Mauriello |
| 5,810,221 | A | 9/1998 | Beletsky |
| 6,276,581 | B1 | 8/2001 | Glock |
| 6,752,300 | B2 | 6/2004 | Har-Shen |

(Continued)

FOREIGN PATENT DOCUMENTS

| | | |
|---|---|---|
| AT | 004574 | 8/2001 |
| DE | 20215678 | 1/2003 |

(Continued)

*Primary Examiner* — Peter N Helvey

(74) *Attorney, Agent, or Firm* — Shaddock Law Group, PC

(57) ABSTRACT

A holster having a holster body; a locking element having a first helical portion defining a first helical ramp surface and a second helical portion defining a second helical ramp surface, wherein the locking element is at least rotatable between a locking element engaged position, wherein at least a portion of the locking projection portion of the locking element protrudes into an at least partial cavity portion of the holster and a locking element disengaged position, wherein at least a portion of the locking projection portion of the locking element is withdrawn from the at least partial cavity portion; and a release lever attached or coupled to a pushrod, and wherein as the release lever is urged toward the locking element, interaction between a first end of the pushrod and the second helical ramp surface causes the locking element to rotate toward the release lever disengaged position.

20 Claims, 13 Drawing Sheets

(56) References Cited

U.S. PATENT DOCUMENTS

| | | | |
|---|---|---|---|
| 2002/0158095 | A1 | 10/2002 | Vor Keller |
| 2004/0050887 | A1 | 3/2004 | Spielberger |
| 2004/0195282 | A1 | 10/2004 | Beletsky |
| 2006/0226185 | A1 | 10/2006 | Har-Shen |

FOREIGN PATENT DOCUMENTS

| | | |
|---|---|---|
| WO | WO02082001 | 10/2002 |
| WO | WO2011008293 | 1/2011 |

HOLSTER WITH PUSHROD DISENGAGEMENT LOCKING ELEMENT

CROSS-REFERENCE TO RELATED APPLICATIONS

This patent application claims the benefit of U.S. patent application Ser. No. 15/683,590, filed Aug. 22, 2017, and U.S. Patent Application Ser. No. 62/378,648, filed Aug. 23, 2016, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of holsters. More specifically, the presently disclosed systems, methods, and/or apparatuses relate to a holster adaptable to be used with a handgun or other firearm.

2. Description of Related Art

It is generally known to carry a handgun in a holster designed to protect the handgun and hold it securely. Holsters can be worn in a number of ways, such as on a belt at the waist, on the thigh, attached or coupled to a plate carrier or tactical vest, under an arm, or around an ankle.

In certain instances, a handgun must be secured or retained within the holster, but quickly and easily removed from the holster, regardless of the type of holster used. Additionally, users need to be assured that, when not in use, the handgun will remain safely in the holster.

Some holsters rely solely on friction to secure the handgun in place. This combination might not be suitable for situations where the gun/holster is subject to a great deal of movement because such movement could cause the handgun to lose frictional engagement with the holster.

Certain other holsters include a variety of strap or flap arrangements that prevent the removal of the firearm from the holster while the strap or flap is in place. With designs that rely on this method to retain a handgun, a user must first unfasten and/or rotate the strap/flap before the firearm can be withdrawn. Then, to re-secure the handgun in the holster once the handgun has been re-holstered, the user must physically refasten and/or rotate the strap/flap before the firearm is securely retained within the holster. Some users might not prefer these designs because of the time required to release and/or re-secure the handgun.

Still other types of holsters include a release lever that is pivotably attached or coupled to the holster body so as to pivot, about a rotation pin or fulcrum point, between a locked position, wherein a protrusion from the release lever is capable of engaging a portion of the handguns trigger guard, and an unlocked position, wherein the release lever is pivoted such that the protrusion is removed from the portion of the handguns trigger guard, to allow the handgun to be withdrawn from the holster.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical holster arrangements have various shortcomings.

In order to overcome the shortcomings of the currently known holster arrangements and/or to provide an improved holster, in various exemplary, non-limiting embodiments, the holster of the presently disclosed systems, methods, and/or apparatuses comprises an at least partially locking element having at least one helix or helical protrusion that extends from at least a portion of the surface of the locking element. Alternatively, the locking element includes a helix or helical recess formed in at least a portion of the surface of the locking element.

In various exemplary, non-limiting embodiments, the holster of the presently disclosed systems, methods, and/or apparatuses comprises a holster body defining an at least partial cavity portion capable of receiving at least a portion of a handgun therein; a locking element, wherein the locking element extends from a proximal end to a distal end, wherein a first helical portion, defining a first helical ramp surface, begins at or proximate the proximal end and extends to a locking projection portion extending from at least a portion of the distal end of the locking element, wherein a second helical portion, defining a second helical ramp surface, begins at or proximate the proximal end and extends toward the distal end of the locking element, wherein the locking element is at least partially rotatable between a locking element engaged position and a locking element disengaged position, wherein at least a portion of the locking element retains the handgun in the holster in the locking element engaged position, via interaction between at least a portion of the locking projection portion and an interior surface of a trigger guard of the handgun, and permits release of the handgun when in the locking element disengaged position; an elongate pushrod, extending from a first end to a second end, wherein at least a portion of the pushrod is slidably positioned within at least a portion of the holster body, such that at least the first end of the pushrod may be urged within the at least partial cavity portion to contact the second helical ramp surface of the second helical portion of the locking element; and a release lever attached or coupled to the second end of the pushrod, wherein the release lever is slidable between a release lever engaged position and a release lever disengaged position, and wherein as the release lever is urged toward the locking element, interaction between the first end of the pushrod and the second helical ramp surface of the second helical portion causes the locking element to rotate to a release lever disengaged position.

In various exemplary, non-limiting embodiments, the holster body comprises a pair of opposed wall portions comprising a first wall portion and a second wall portion and a pair of opposed wall portions comprising a third wall portion and a fourth wall portion. Alternatively, the holster body optionally comprises a single, continuous wall portion or multiple coupled or joined wall portions.

In various exemplary, non-limiting embodiments, the at least partial cavity portion includes a holster trigger guard portion shaped so as to receive and accommodate at least a portion of the trigger guard of an inserted handgun.

In various exemplary, non-limiting embodiments, the first helical ramp surface is a helical recess or a helical protrusion, is formed in or around at least a portion of the locking element, provides an incurved rim that curves around at least a portion of the locking element, and/or generally follows a spiral or a curve along a portion of the locking element.

In various exemplary, non-limiting embodiments, the second helical ramp surface is a helical recess or a helical protrusion, is formed in or around at least a portion of the locking element, provides an incurved rim that curves around at least a portion of the locking element, and/or generally follows a spiral or a curve along a portion of the locking element.

In various exemplary, non-limiting embodiments, at least a portion of the pushrod is positioned within a portion of a pushrod channel formed in or through at least a portion of the holster body.

In various exemplary, non-limiting embodiments, the locking element is positioned at least partially within a holster recess.

In various exemplary, non-limiting embodiments, if the locking element is in the engaged position, at least a portion of the locking projection portion of the locking element protrudes into the at least partial cavity portion a sufficient distance to extend inside at least a portion of the trigger guard of the handgun if the handgun is seated within the at least partial cavity portion of the holster.

In various exemplary, non-limiting embodiments, the locking element is biased to the locking element engaged position and the release lever is biased to the release lever engaged position.

In various exemplary, non-limiting embodiments, the release lever is accessible by a user's thumb.

In various exemplary, non-limiting embodiments, the release lever is accessible by at least one of a user's fingers.

In various exemplary, non-limiting embodiments, the holster of the presently disclosed systems, methods, and/or apparatuses comprises a holster body defining an at least partial cavity portion capable of receiving at least a portion of the handgun therein; a locking element, wherein the locking element extends from a proximal end to a distal end, wherein a first helical portion, defining a first helical ramp surface, begins at or proximate the proximal end and extends to a locking projection portion extending from at least a portion of the distal end of the locking element, wherein a second helical portion, defining a second helical ramp surface, begins at or proximate the proximal end and extends toward the distal end of the locking element, wherein the locking element is at least partially rotatable between a locking element engaged position and a locking element disengaged position, wherein in the locking element engaged position at least a portion of the locking projection portion of the locking element protrudes into the at least partial cavity portion a sufficient distance to extend inside at least a portion of a trigger guard of the handgun if the handgun is seated within the at least partial cavity portion of the holster, wherein in the locking element disengaged position at least a portion of the locking projection portion of the locking element is withdrawn from the at least partial cavity portion a sufficient distance to be withdrawn from the trigger guard of the handgun if the handgun is seated within the at least partial cavity portion of the holster and permit release of the handgun when in the locking element disengaged position; an elongate pushrod, wherein at least a portion of the pushrod is slidably positioned within at least a portion of the holster body, such that at least the first end of the pushrod may be urged within the at least partial cavity portion to contact the second helical ramp surface of the second helical portion of the locking element; and a release lever attached or coupled to a second end of the pushrod, wherein the release lever is slidable between a release lever engaged position and a release lever disengaged position, and wherein as the release lever is urged toward the locking element, interaction between a first end of the pushrod and the second helical ramp surface of the second helical portion causes the locking element to rotate to a release lever disengaged position.

In various exemplary, non-limiting embodiments, the holster of the presently disclosed systems, methods, and/or apparatuses comprises a holster body defining an at least partial cavity portion capable of receiving at least a portion of the handgun therein; a locking element, wherein the locking element extends from a proximal end to a distal end, wherein a first helical portion, defining a first helical ramp surface, begins at or proximate the proximal end and extends to a locking projection portion extending from at least a portion of the distal end of the locking element, wherein a second helical portion, defining a second helical ramp surface, begins at or proximate the proximal end and extends toward the distal end of the locking element, wherein the locking element is at least partially rotatable between a locking element engaged position and a locking element disengaged position, wherein in the locking element engaged position at least a portion of the locking projection portion of the locking element protrudes into the at least partial cavity portion a sufficient distance to extend inside at least a portion of a trigger guard of the handgun if the handgun is seated within the at least partial cavity portion of the holster, wherein in the locking element disengaged position at least a portion of the locking projection portion of the locking element is withdrawn from the at least partial cavity portion a sufficient distance to be withdrawn from the trigger guard of the handgun; an elongate pushrod, wherein at least a portion of the pushrod is slidably positioned within at least a portion of the holster body; and a release lever attached or coupled to a second end of the pushrod, wherein the release lever is slidable between a release lever engaged position and a release lever disengaged position, and wherein as the release lever is urged toward the locking element, interaction between a first end of the pushrod and the second helical ramp surface of the second helical portion causes the locking element to rotate to a release lever disengaged position.

In various exemplary, non-limiting embodiments, the holster of the presently disclosed systems, methods, and/or apparatuses comprises a holster having a holster body; a locking element having a first helical portion defining a first helical ramp surface and a second helical portion defining a second helical ramp surface, wherein the locking element is at least rotatable between a locking element engaged position, wherein at least a portion of the locking projection portion of the locking element protrudes into an at least partial cavity portion of the holster and a locking element disengaged position, wherein at least a portion of the locking projection portion of the locking element is withdrawn from the at least partial cavity portion; and a release lever attached or coupled to a pushrod, and wherein as the release lever is urged toward the locking element, interaction between a first end of the pushrod and the second helical ramp surface causes the locking element to rotate toward the release lever disengaged position.

Accordingly, the holster of the present disclosure separately and optionally provides a quick-release handgun holster.

The holster of the present disclosure separately and optionally provides a handgun holster, which is capable of retaining a handgun securely in the holster while permitting a release of the handgun when the user requires.

The holster of the present disclosure separately and optionally provides a handgun holster, which is simple to operate.

The holster of the present disclosure separately and optionally provides a handgun holster, which secures the handgun in the holster upon seating of the handgun in the holster, without requiring any additional operation by the user.

The presently disclosed systems, methods, and/or apparatuses separately and optionally provide a holster that can be easily manipulated by a user.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
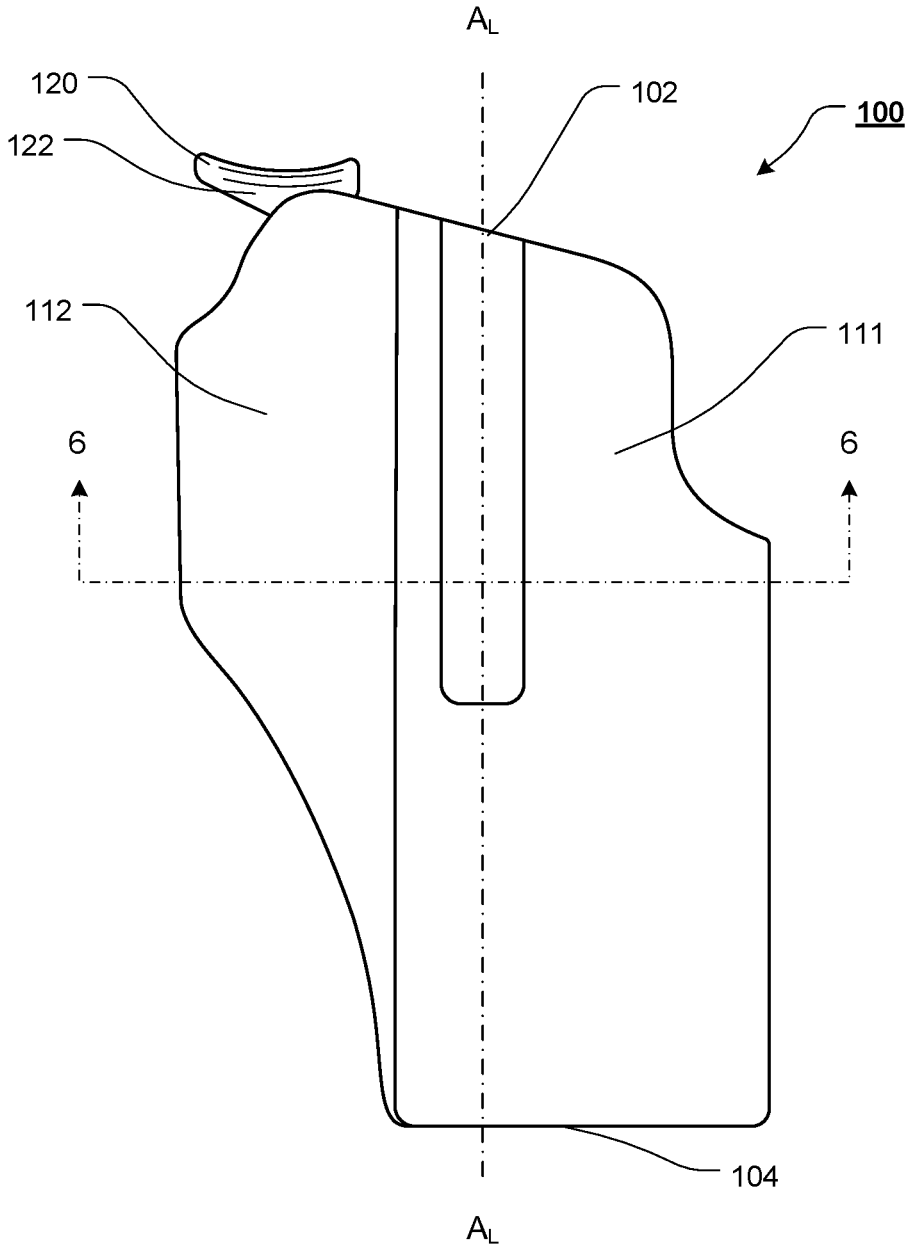
FIG. 1 illustrates a right side view of an exemplary embodiment of a holster, according to the presently disclosed systems, methods, and/or apparatuses.
Figure 2:
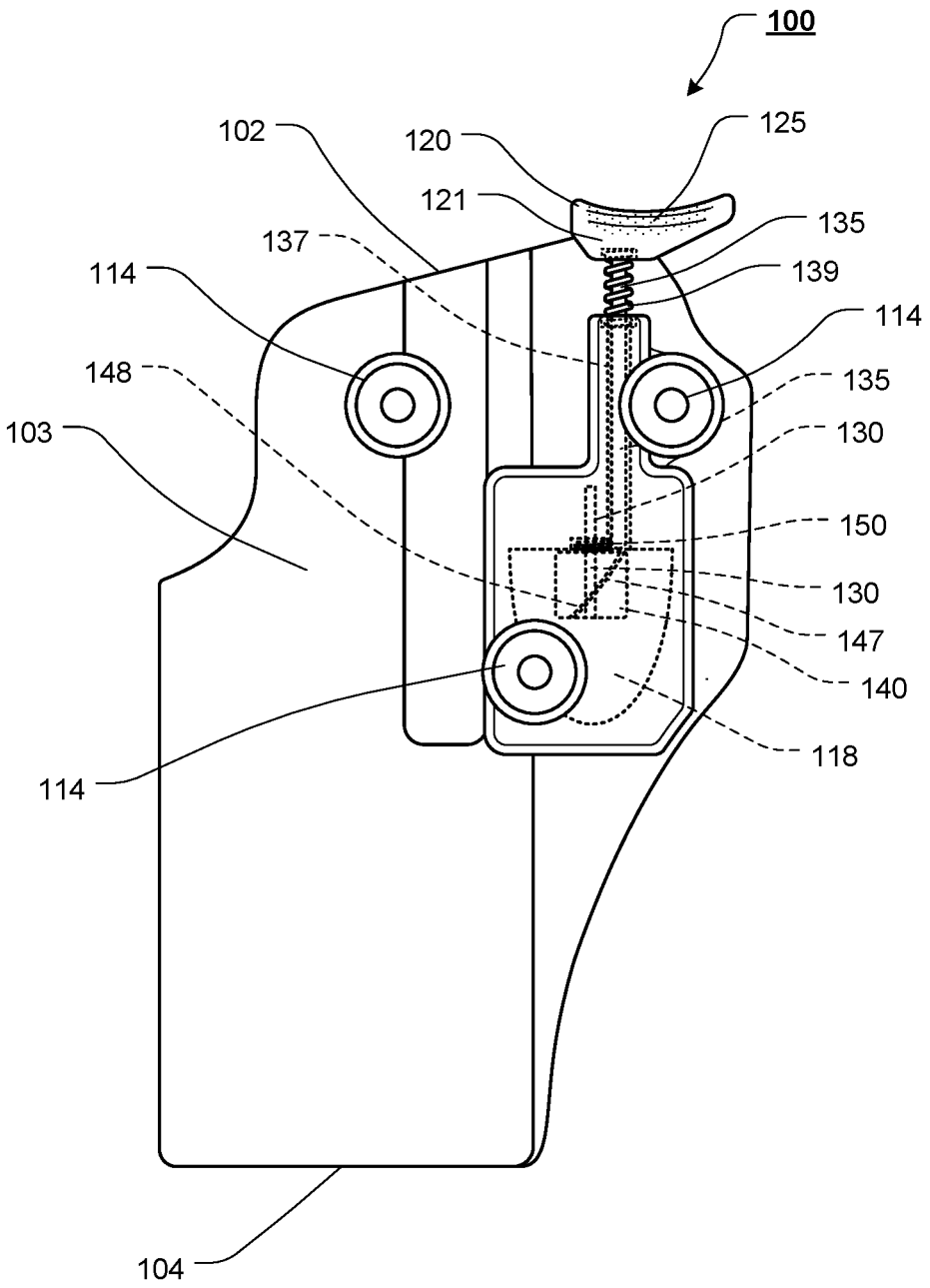
FIG. 2 illustrates a left side view of an exemplary embodiment of a holster, in a locked position, according to the presently disclosed systems, methods, and/or apparatuses.

For simplicity and clarification, the design factors and operating principles of the holster according to the presently disclosed systems, methods, and/or apparatuses are explained with reference to various exemplary embodiments of a holster according to the presently disclosed systems, methods, and/or apparatuses. The basic explanation of the design factors and operating principles of the holster is applicable for the understanding, design, and operation of the holster of the presently disclosed systems, methods, and/or apparatuses. It should be appreciated that the holster can be adapted to many applications where a holster can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "handgun" and "holster" are used for a basic explanation and understanding of the operation of the systems, methods, and apparatuses of this invention. Therefore, the terms "handgun" and "holster" are not to be construed as limiting the systems, methods, and apparatuses of this invention.

Furthermore, it should be appreciated that, for simplicity and clarification, the embodiments of this invention will be described with reference to a semiautomatic-type handgun being secured within the holster of the present disclosure. However, it should be appreciated that the operating principles of the disclosed holster may also be employed to construct holsters or holders for any revolver or semiautomatic-type handgun, edged weapons as well as less than lethal products (i.e., tasers, pepper spray, mace canisters, or batons), so long as these items have an appropriate ledge or void that may be engaged or retained by a locking projection or other retaining means. Furthermore, it is also within the scope of the present invention that the present holster may be employed as a pouch for tactical accessories, such as ammunition magazines and/or flashlights, as well as for everyday items such as cell phones or personal digital assistants.

Turning now to the appended drawing figures, FIGS. 1-12 illustrate certain elements and/or aspects of a holster 100 according to this invention. It should be appreciated that the holster 100 is adapted to retain an exemplary semiautomatic-type handgun 180. The semiautomatic-type handgun 180 generally includes a slide portion 183 and a frame portion 185. The frame portion 185 generally includes a dust cover, a grip, a trigger guard 186, and a trigger. The trigger guard 186 includes an outer surface 187, which defines the outer perimeter of the trigger guard 186 and an inner surface 188, which defines an area where the trigger is located and allows a user's finger access to the trigger.

In illustrative, non-limiting embodiments of the presently disclosed systems, methods, and/or apparatuses, as illustrated in FIGS. 1-12, the illustrated, exemplary holster 100 includes a holster body 103 defining an at least partial cavity portion 105 for receiving and holding the handgun 180. The holster body 103 comprises a pair of opposed wall portions comprising a first wall portion 106 and a second wall portion 107 and a pair of opposed wall portions comprising a third wall portion 108 and a fourth wall portion 109. Typically, the first wall portion 106 is considered the inner side of the holster 100 and is worn against or adjacent the user's body, while the second wall portion 107 is considered the outer side of the holster 100 and is worn away from the user's body. The third wall portion 108 and the fourth wall portion 109 form additional side wall portions of the holster 100 and may be included to assist in maintaining at least portions of the handgun 180 within at least a portion of the holster body 103.

However, it should be appreciated that the holster 100 may be formed such that one or more of the first wall portion 106, the second wall portion 107, the third wall portion 108, and/or the fourth wall portion 109 is/are sufficient to define the at least partial cavity portion 105 for receiving the handgun 180 and the remaining wall portions are not included.

The at least partial cavity portion 105 includes a holster frame top portion 102 and a holster frame bottom portion 104 and may be formed from any number or combination of wall portions, including, for example, a single, continuous wall portion or multiple coupled or joined wall portions. Thus, the at least partial cavity portion 105 may be formed by any cavity, partial cavity, space, or platform that is capable of retaining a handgun 180.

In certain exemplary, nonlimiting embodiments, the holster body 103 merely comprises a single wall portion, such as, for example, the first wall portion 106. Any remaining portions of the holster 100 may be attached, coupled, or formed as a portion or extension of the first wall portion 106 and/or the holster body 103.

In certain exemplary, nonlimiting embodiments, as illustrated, the holster body 103 and/or the at least partial cavity portion 105 includes a holster trigger guard portion 112. At least a portion of the holster trigger guard portion 112 is shaped to receive and accommodate at least a portion of the trigger guard 186 of an inserted handgun 180. In various exemplary embodiments, the holster trigger guard portion 112 is generally formed by a portion of the body of the holster 100. The holster trigger guard portion 112 is shaped generally to match the contours of at least a portion of the outer surface 187 of the trigger guard 186. The holster trigger guard portion 112 is formed to contact at least a portion of the outer surface 187 of the trigger guard 186 of the inserted handgun 180 and further limit how far the handgun 180 can be inserted into the holster 100.

The construction of the holster 100 further facilitates alignment of the trigger guard 186 with the locking projection portion 146 by limiting lateral movement of the handgun 180 with respect to the release lever 120 and the locking projection portion 146 without preventing a user from easily holstering or drawing the handgun 180.

It should be noted that the wall portions of the holster 100 may generally be planar. Alternatively, the wall portions of the holster 100 may be contoured or shaped to better accommodate a specific type or model of handgun 180 to be retained within the holster 100.

In various exemplary embodiments, the holster 100 optionally includes at least one holster frame attachment portion 114, which provides one or more areas, portions, or devices for fastening the holster 100 to a holster holding device. Alternatively, the means for holster frame attachment portion 114 may comprise a clip or hook adapted to, for example, be clipped over or to a belt. In further exemplary embodiments, the holster frame attachment portion 114 may comprise one or more quick-disconnect or other couplings, which may be permanently or removably coupled to corresponding and cooperating coupling(s) provided on a belt or other carrier or platform. In still other exemplary embodiments, the holster 100 may comprise an integral belt, or may comprise one or more connections for attachment to a chest, ankle, leg, shoulder, or other harness or band, or for otherwise securing the holster 100 to a user or the user's apparel.

In various exemplary embodiments, the holster 100 is substantially rigid and is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, woven fiber, natural materials, such as, for example, leather, and/or various combinations of the foregoing.

Thus, it should be understood that the material or materials used to form the holster 100 and/or various components of the holster 100 is a design choice based on the desired appearance and functionality of the holster 100.

As further shown in FIGS. 1-12, the holster 100 comprises a locking element 140. The locking element 140 is capable of operating to retain a handgun 180 securely in the holster 100 by restricting withdrawal of the handgun 180 from the at least partial cavity portion 105 of the holster 100 when in an engaged position, while permitting a release of the handgun 180 when in a disengaged position.

In various exemplary, nonlimiting embodiments, the locking element 140 comprises a substantially cylindrical portion of material extending from a proximal end 141 to a distal end 142 and having a first helical portion 145 formed in or around at least a portion of the locking element 140 and a second helical portion 147 formed in or around at least a portion of the locking element 140. In certain alternative embodiments, the locking element 140 may have an overall cylindrical or conical shape. Thus, the locking element 140 may have a substantially consistent diameter, an increasing diameter, or a decreasing diameter from the proximal end 141 to the distal end 142.

The first helical portion 145 begins at or proximate said proximal end 141 and extends to a locking projection portion 146 extending from at least a portion of the distal end 142 of the locking element 140.

In various exemplary embodiments, the locking element 140 includes a helix or helical protrusion or first helical portion 145 that extends from at least a portion of the surface of the locking element 140, forming a helically threaded portion. Alternatively, the locking element 140 includes a helix or helical recess formed in at least a portion of the surface of the locking element 140. Whether a protrusion or recess, the first helical portion 145 provides a first helical ramp surface 144 or incurved rim that curves around at least a portion of the locking element 140. In certain exemplary embodiments, the first helical portion 145 or first helical ramp surface 144 generally follows a spiral or a curve along a portion of the locking element 140 that can be defined by the rotation of a point crossing cross-sections (taken perpendicular to the longitudinal axis of the locking element 140) of the first helical portion 145, at a consistent, oblique angle.

Figure 13:
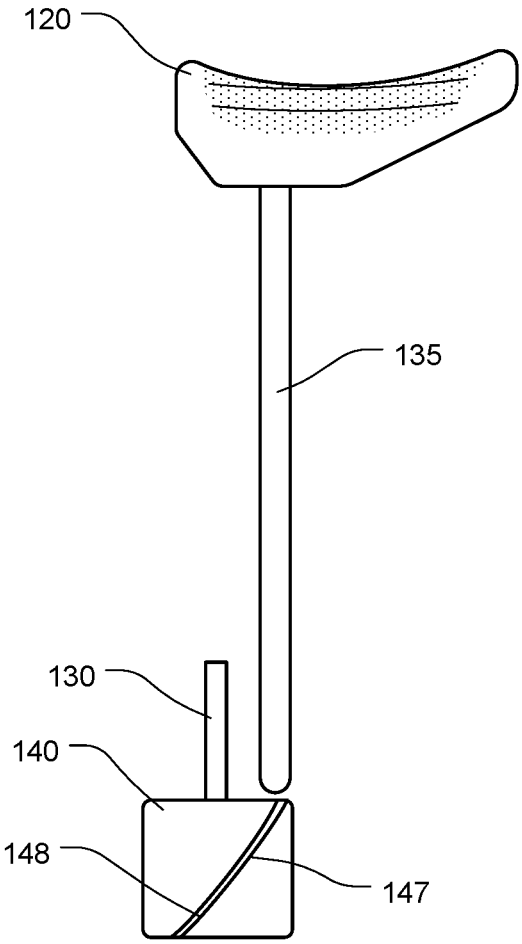
FIG. 13 illustrates a left side view of an exemplary embodiment of a pushrod and locking element, according to the presently disclosed systems, methods, and/or apparatuses.

As illustrated, for example, in FIG. 13, second helical portion 147 begins at or proximate said proximal end 141 (generally on an opposing side of the locking element 140 from the beginning of the first helical portion 145) and extends toward or to the distal end 142 of the locking element 140.

In various exemplary embodiments, the locking element 140 includes a helix or helical protrusion or second helical portion 147 that extends from at least a portion of the surface of the locking element 140, forming a helically threaded portion. Alternatively, the locking element 140 includes a helix or helical recess formed in at least a portion of the surface of the locking element 140. Whether a protrusion or recess, the second helical portion 147 provides a second helical ramp surface 148 or incurved rim that curves around at least a portion of the locking element 140. In certain exemplary embodiments, the second helical portion 147 or second helical ramp surface 148 generally follows a spiral or a curve along a portion of the locking element 140 that can be defined by the rotation of a point crossing cross-sections (taken perpendicular to the longitudinal axis of the locking element 140) of the second helical portion 147, at a consistent, oblique angle.

In various exemplary embodiments, the first helical portion 145 (including the first helical ramp surface 144) and the second helical portion 147 (including the second helical ramp surface 148) are formed as a single, continuous, helical ramp surface. Thus, the locking element 140 may include a single helical portion having a single helical ramp surface or a double helical portion including a first helical portion with a first helical ramp surface and a second helical portion with a second helical ramp surface.

The locking element 140 is attached or coupled at or proximate the proximal end 141 of a rotation pin 130, which extends from a portion of the holster body 103. In certain exemplary embodiments, the locking element 140 is attached or coupled to a terminal end of the rotation pin 130. In certain other exemplary embodiments, the locking element 140 is at least partially attached or coupled to the rotation pin 130 via a locking element securing element 160.

In various exemplary embodiments, the locking element 140 is attached or coupled to the rotation pin 130 at a cross-sectional center of the locking element 140. Alternatively, the locking element 140 is attached or coupled to the rotation pin 130 at a point that is offset from the cross-sectional center of the locking element 140. Thus, the locking element 140 may be rotated by the rotation pin 130 in a substantially consistent or offset manner.

In certain exemplary, nonlimiting embodiments, the rotation pin 130 comprises a separate portion of material extending out of or from the holster body 103. Alternatively, the rotation pin 130 may optionally comprise an extension of material used to form at least a portion of the holster body 130. Thus, the rotation pin 130 may comprise a separate element or an integral component that extends from the holster body 130.

In various exemplary embodiments, the locking element 140 may optionally be biased to the engaged position, whether a handgun 180 is present in the holster 100 or absent from the holster 100. In various exemplary embodiments, biasing of the locking element 140 may be accomplished by, for example, a locking element biasing element 150 secured between at least a portion of the holster body 103 and at least a portion of the locking element 140. In various exemplary embodiments, the locking element 140 includes a biasing element receiving groove 149 formed in the locking element 140 that engages an end portion of the locking element biasing element 150. The locking element biasing element 150 may comprise a coil or other spring or any suitable spring mechanism or resilient element.

The locking element 140 is rotatable within at least a portion of the holster trigger guard portion 112. In certain exemplary, nonlimiting embodiments, the locking element 140 is positioned at least partially within a holster recess 118 formed to allow the locking element 140 to rotate freely without contact or interaction from external objects are forces on a side opposite the holster recess 118.

A pushrod channel 137 is formed in or through at least a portion of the holster body 103. In various exemplary embodiments, the pushrod channel 137 is formed through the material forming the holster body 103. Alternatively, the pushrod channel 137 is formed to include an at least partial pushrod channel 137 insulator or other material. If included, the insulator or other material aids in the smooth slidable movement of at least a portion of the pushrod 135 within the pushrod channel 137. The pushrod channel 137 is formed to have an inner diameter that allows at least a portion of the pushrod 135 to be fitted within the pushrod channel 137 and substantially freely slide, in a lateral fashion, within the pushrod channel 137.

Generally, the pushrod channel 137 is formed proximate the holster trigger guard portion 112, such that when the pushrod 135 is slidably inserted within the pushrod channel 137, at least a first end portion of the pushrod 135 may extend within a holster recess 118 to contact the second helical ramp surface 148 of the second helical portion 147 of the locking element 140.

In various exemplary embodiments, the pushrod channel 137 is positioned substantially parallel to a longitudinal axis, $A_L$, of the holster 100, substantially perpendicular to a longitudinal axis of the holster 100, at a substantially acute angle relative to a longitudinal axis of the holster 100, or at a substantially obtuse angle relative to a longitudinal axis of the holster 100. Thus, the pushrod channel 137 may be positioned at any angle relative to either a longitudinal axis, $A_L$, or other axis of the holster 100.

A release lever 120 is attached or coupled at a second end or proximate a second end of the pushrod 135. The pushrod 135 generally comprises an elongate portion of material extending from a first end to a second end. In various exemplary embodiments, the pushrod 135 has a substantially circular cross-section. Alternatively, the pushrod 135 may have a substantially ovular, triangular, square, octagonal, or other desired cross-section.

In certain exemplary embodiments, the release lever 120 is attached or coupled to a terminal second end of the pushrod 135. The release lever 120 includes a first side 121 facing generally outward from the holster 100, away from the at least partial cavity portion 105, and a second side 122 facing generally toward the at least partial cavity portion 105.

In various exemplary embodiments, the first side 121 of the release lever 120 includes a textured portion 125. In this manner, the first side 121 of the release lever 120 may be distinguished tactilely from other portions of the release lever 120 or the holster 100.

Figure 3:
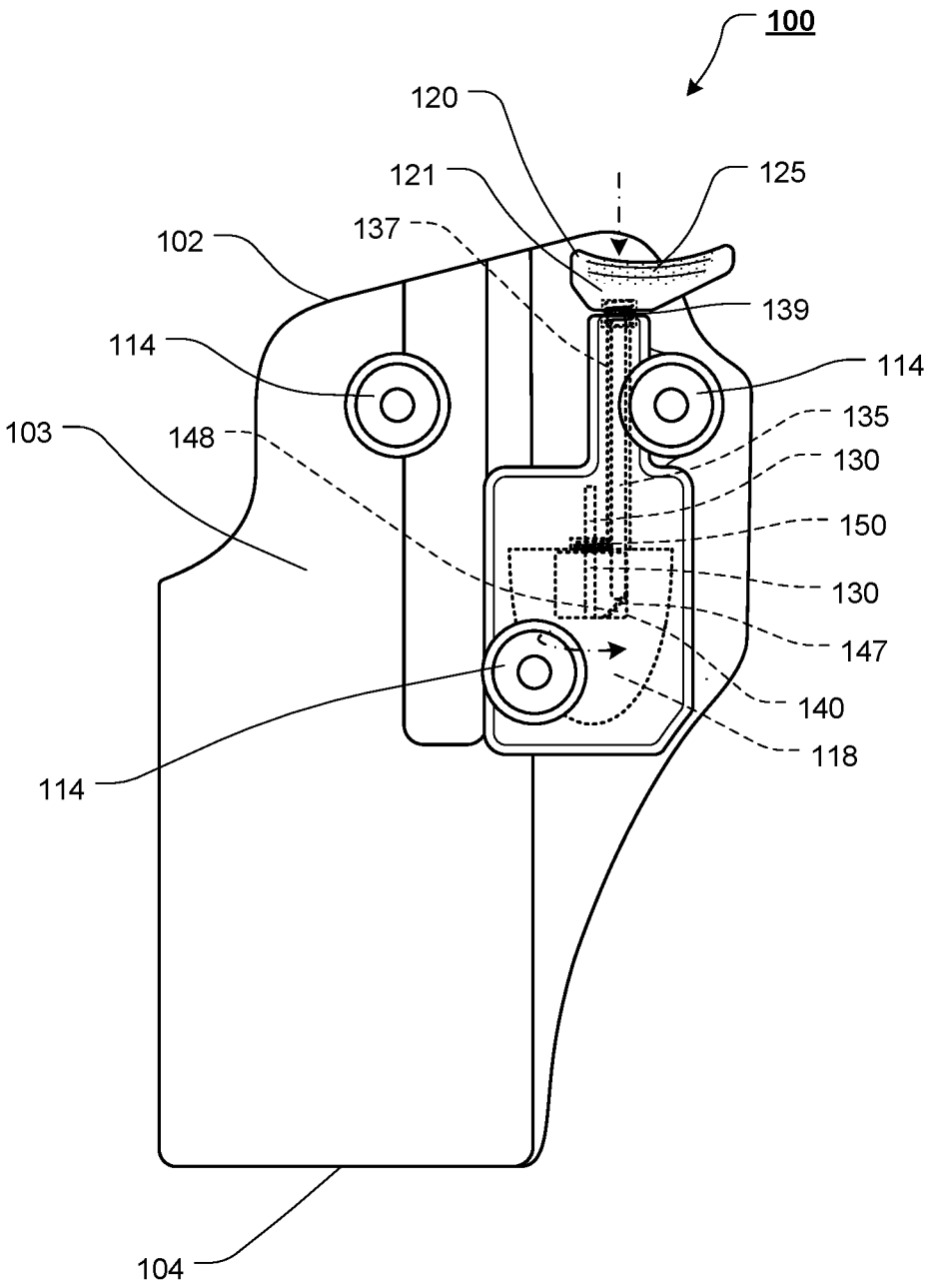
FIG. 3 illustrates a left side view of an exemplary embodiment of a holster, in an unlocked position, according to the presently disclosed systems, methods, and/or apparatuses.
Figure 4:
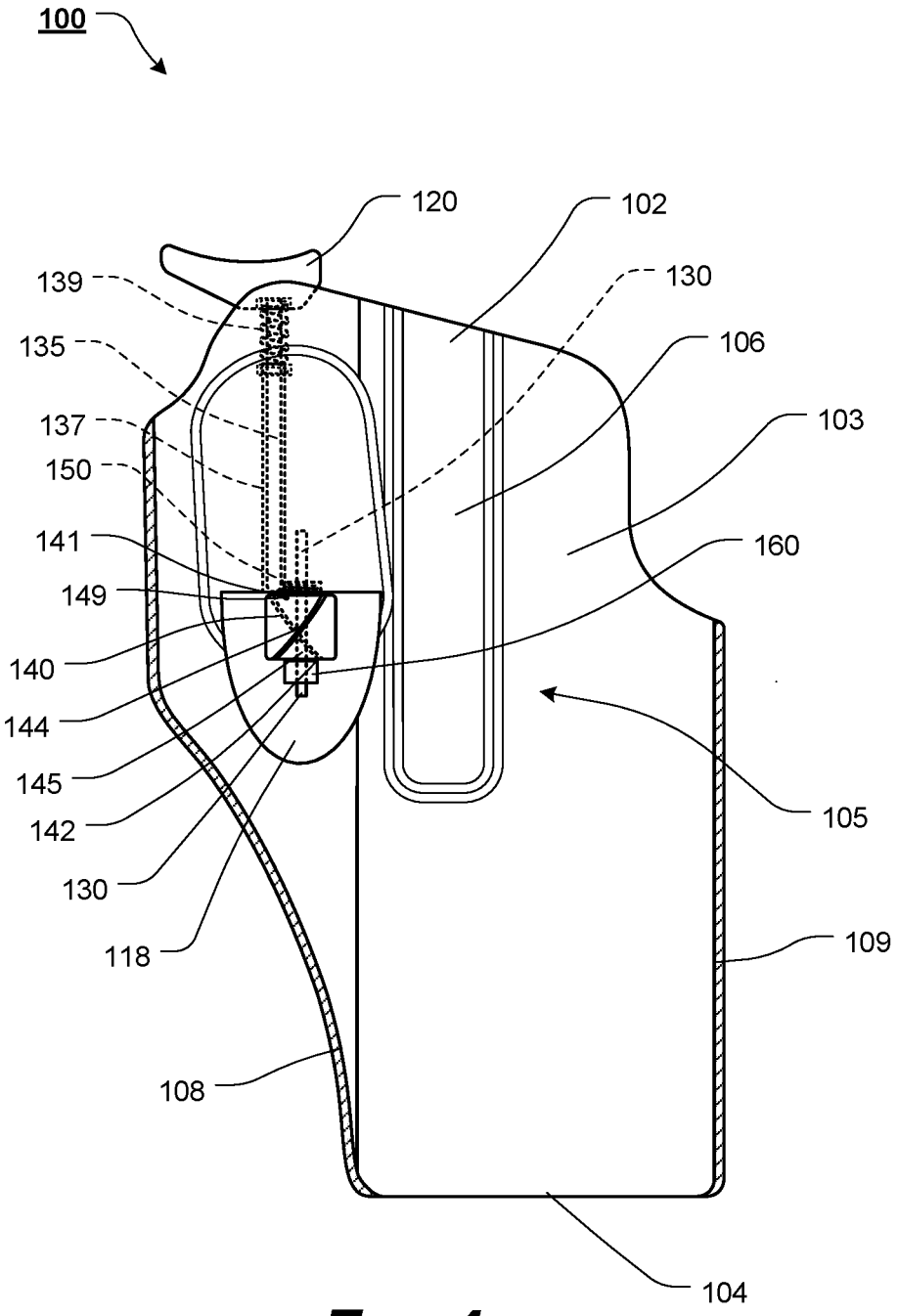
FIG. 4 illustrates a right side, cross-sectional view of an exemplary embodiment of a holster, in a locked position, according to the presently disclosed systems, methods, and/or apparatuses.
Figure 12:
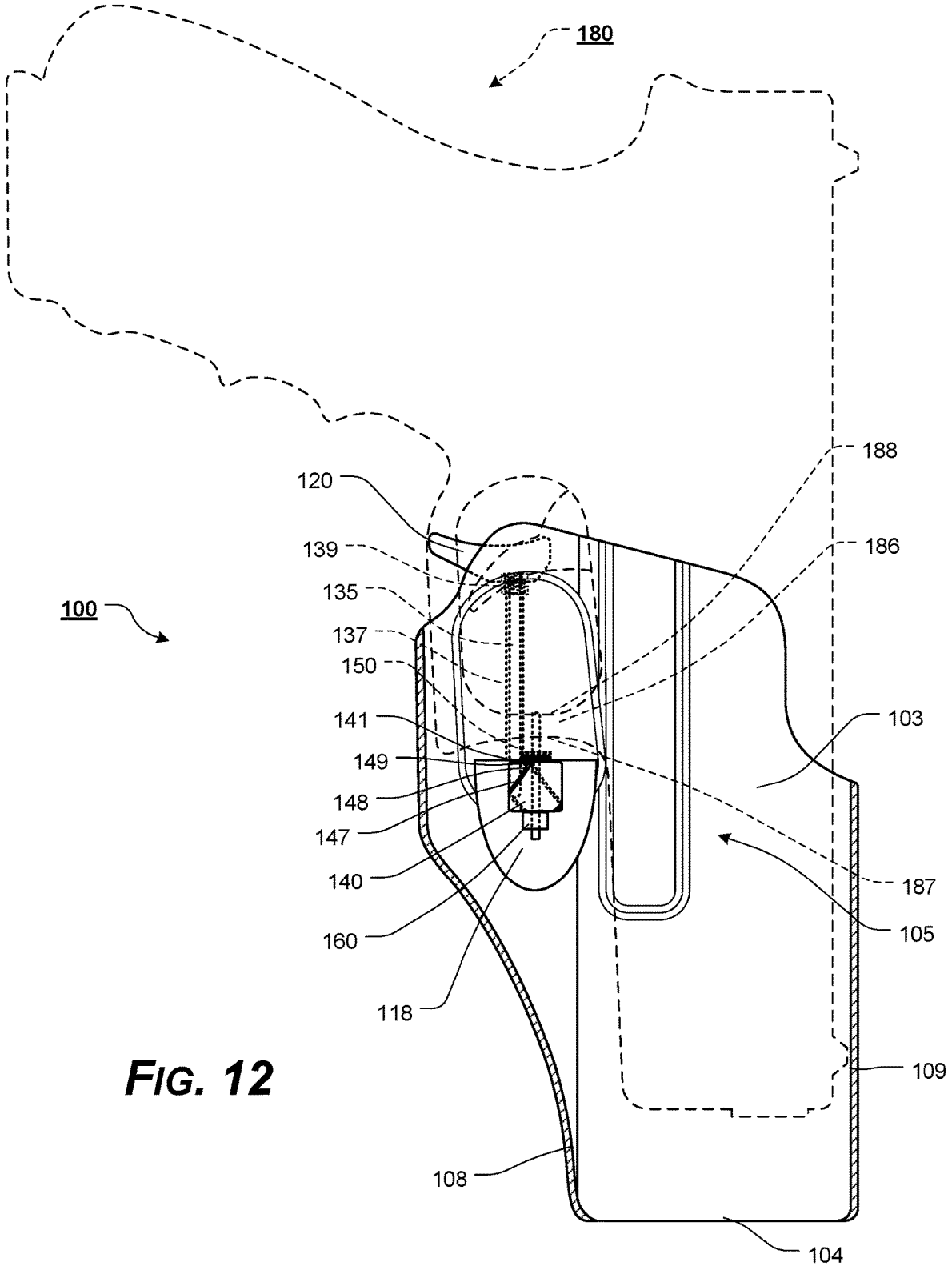
FIG. 12 illustrates a right side, cross-sectional view of an exemplary embodiment of a holster, wherein the locking element is rotated to an unlocked position and an exemplary handgun is partially withdrawn from the holster, according to the presently disclosed systems, methods, and/or apparatuses.

The release lever 120 is slidable, via the pivot rod 130, between a disengaged position, as illustrated most clearly in FIGS. 1, 2, 4-6, and 9 and an engaged position, as illustrated in FIGS. 3 and 12. In the disengaged position, the first end of the pushrod 135 optionally does not make sufficient contact with the second helical portion 147 or the second helical ramp surface 148 of the locking element 140 to cause the locking element 140 to rotate toward the disengaged unlocked position. As the release lever 120 is urged downward, toward the locking element 140, the first end of the pushrod 135 contacts the second helical portion 147 and/or the second helical ramp surface 148. As the release lever 120 (and the pushrod 135) continue to be urged toward the locking element 140, interaction between the first end of the pushrod 135 and the second helical ramp surface 148 of the second helical portion 147 causes the locking element 140 to rotate, about the rotation pin 130.

Thus, when the pushrod 135 is slidably positioned within the pushrod channel 137, linear manipulation of the release lever 120 (movement either toward or away from the locking element 140), results in rotation of the locking element 140. Thus, the locking element 140 can be at least partially rotated relative to the holster trigger guard portion 112.

In various exemplary embodiments, the release lever 120 (and the pushrod 135) may optionally be biased to the disengaged position, whether a handgun 180 is present in the holster 100 or absent from the holster 100. In various exemplary embodiments, biasing of the release lever 120 (and the pushrod 135) may be accomplished by, for example, a release lever biasing element 139 secured between at least a portion of the holster body 103 and at least a portion of the release lever 120. In various exemplary embodiments, the locking element biasing element 139 may comprise a coil or other spring or any suitable spring mechanism or resilient element.

When a handgun 180 is seated within the holster 100 and the locking element 140 is in the engaged position, at least a locking projection portion 146 of the locking element 140 extends from the holster recess 118 a sufficient distance to protrude within the trigger guard 186 and potentially contact at least an inner surface 188 of the trigger guard 186. When the locking element 140 is in the disengaged position, the locking projection portion 146 is retracted into the holster recess 118 a sufficient distance to allow at least an inner surface 188 of the trigger guard 186 to pass by the locking projection portion 146.

While the locking projection portion 146 is primarily shown and described as being positioned so that the locking projection portion 146 may extend into the cavity portion 105 and potentially engage an inner surface 188 of the trigger guard 186, it should be appreciated that the locking element 140 may be positioned at any portion of the holster body 103 so that the locking projection portion 146 may extend into the cavity portion 105 and potentially engage any surface or shoulder of the handgun 180. For example, the locking element 140 may be positioned so that the locking projection portion 146 may extend into the cavity portion 105 and potentially engage an ejection port of the handgun 180.

Regardless of the particular handgun 180 to be used in conjunction with the holster 100, the locking projection portion 146 should be shaped so that there is no possibility that the locking projection portion 146 can at any time contact the trigger of the handgun 180. When the handgun 180 is pushed as far forward as possible into the holster 100, a space is maintained between the locking projection portion 146 and the trigger of the handgun 180.

When the release lever 120 is in the engaged position, the locking projection portion 146 protrudes to extend inside the at least a portion of the cavity portion 105 and inside the trigger guard 186 of a handgun 180 that is seated in the holster 100 and, thereby, resist or block withdrawing or rearward movement of the handgun 180 and retain the handgun 180 in the holster 100.

In various exemplary embodiments, the locking projection portion 146 protrudes into the at least partial cavity portion 105 for a distance that is less than the width of the trigger guard 186. Alternatively, the locking projection portion 146 may protrude into the at least partial cavity portion 105 for a distance that is equal to or greater than the width of the trigger guard 186.

Figure 14:
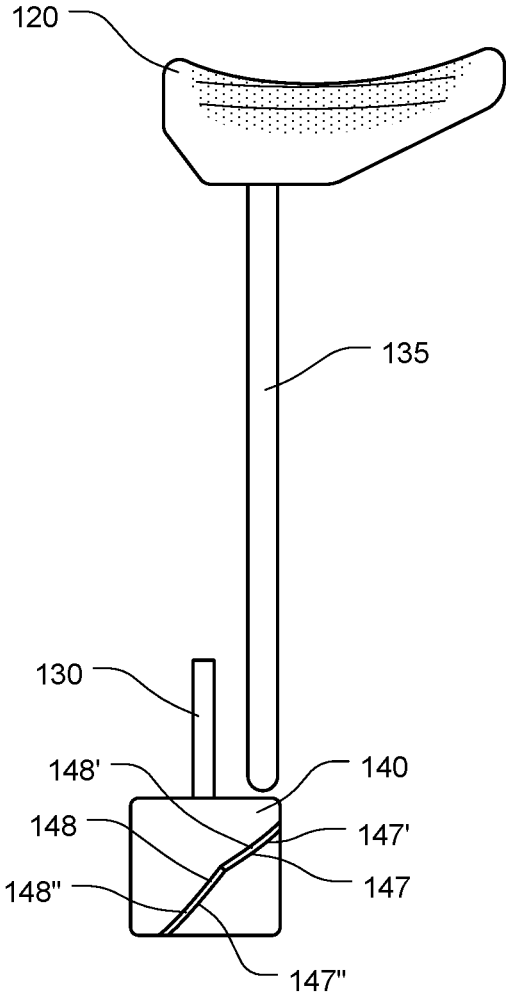
FIG. 14 illustrates a left side view of an exemplary embodiment of a pushrod and locking element, according to the presently disclosed systems, methods, and/or apparatuses.

In various exemplary embodiments, as illustrated, for example, in FIG. 14, the second helical portion 147 (including the second helical ramp surface 148) may optionally be formed as a multipart or multi-ramped surface. As illustrated, for example, the second helical portion 147 may be comprised of an initial helical portion 147' and a subsequent helical portion 147" (and an initial helical ramp surface 148' and a subsequent helical ramp surface 148"). By forming the second helical portion 147 as a multipart or multi-ramped surface, as the first end of the pushrod 135 contacts the initial helical portion 147', continuing lateral movement of the pushrod 135 (along the longitudinal axis of the pushrod 135), along the initial helical portion 147', produces a first degree of angular rotation of the locking element 140. As the pushrod 135 is urged further toward the locking element 140, the first end of the pushrod 135 transitions from contacting the initial helical portion 147' and contacts the subsequent helical portion 147". As the first end of the pushrod 135 contacts the subsequent helical portion 147", continuing lateral movement of the pushrod 135, along the subsequent helical portion 147", produces a second degree of angular rotation of the locking element 140.

While FIG. 14, illustrates the initial helical portion 147' as having a shallower pitch than the subsequent helical portion 147", it should be appreciated that this is merely illustrative and not limiting. Therefore, it should be appreciated that the initial helical portion 147' may have a pitch that is steeper than the pitch of the subsequent helical portion 147". Furthermore, the number of helical portions comprising the second helical portion 147 is a design choice. Additionally, the pitch or angle of each portion of the second helical portion 147 is also a design choice.

Thus, different or varying angular ramped or other surfaces along the locking element 140 can allow different degrees of angular rotation of the locking element, as the pushrod 135 engages different portions of the second helical portion 147 and the second helical ramp surface 148. In this manner, different levels of engagement provided by the locking element 140 can be produced, based upon the position of the first end of the pushrod 135 along the second helical portion 147. It should be appreciated that the pitch, angle, or presentation of the second helical portion 147 and the second helical ramp surface 148 is a design choice based upon the desired level of angular rotation of the locking element 140 at various positions of the pushrod 135. Therefore, alterations in the pitch, angle, or presentation of the second helical portion 147 and the second helical ramp surface 148 and alter the engagement or clearance of mating surfaces.

During use of the embodiment illustrated in FIG. 14, as the release lever 120 is urged downward, toward the locking element 140, the first end of the pushrod 135 initially contacts initial helical portion 147'. As the release lever 120 (and the pushrod 135) continue to be urged toward the locking element 140, interaction between the first end of the pushrod 135 and the initial helical portion 147' of the second helical portion 147 causes the locking element 140 to rotate about the rotation pin 130.

As the release lever 120 (and the pushrod 135) are further urged toward the locking element 140, the first end of the pushrod 135 interacts with the subsequent helical portion 147" of the second helical portion 147, causing the locking element 140 to rotate about the rotation pin 130 at a rotational rate, per distance traveled by the pushrod 135, that is greater than the rotational rate, per distance traveled by the pushrod 135, as the first end of the pushrod 135 interacts with the initial helical portion 147'. In this manner, as a user initially depresses the release lever 120, a lesser amount of downward transition of the release lever 120 is required to cause initial rotation of the locking element 140. As the user continues to depress the release lever, and the first end of the pushrod 135 transitions from the initial helical portion 147' to the subsequent helical portion 147", a greater amount of downward transition of the release lever is required to cause a similar degree of rotation of the locking element 140.

Various exemplary embodiments, first end of the pushrod 135 may optionally comprise a surface or terminal surface that corresponds to or meets with a surface of the second helical portion 147 and/or the second helical ramp surface 148.

During use of the holster 100, as illustrated in FIGS. 5-12, as the handgun 180 is inserted into the at least partial cavity portion 105 of the holster 100, muzzle first, the handgun 180 is guided into position by at least some portion of the holster 100, such as, for example, the first wall portion 106, the second wall portion 107, the third wall portion 108, and/or the fourth wall portion 109.

Figure 5:
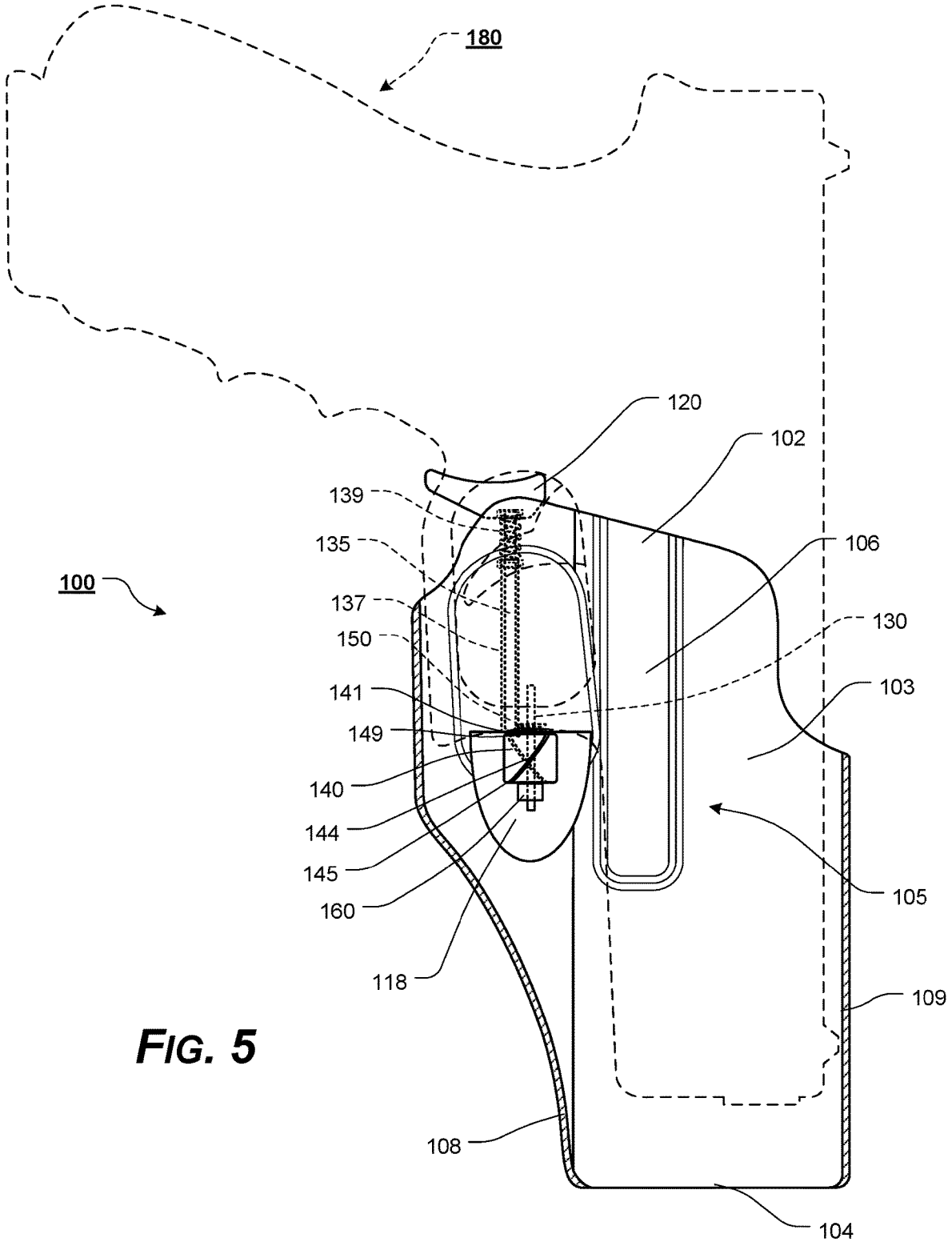
FIG. 5 illustrates a right side, cross-sectional view of an exemplary embodiment of a holster, wherein an exemplary handgun is partially inserted within the holster, according to the presently disclosed systems, methods, and/or apparatuses.
Figure 6:
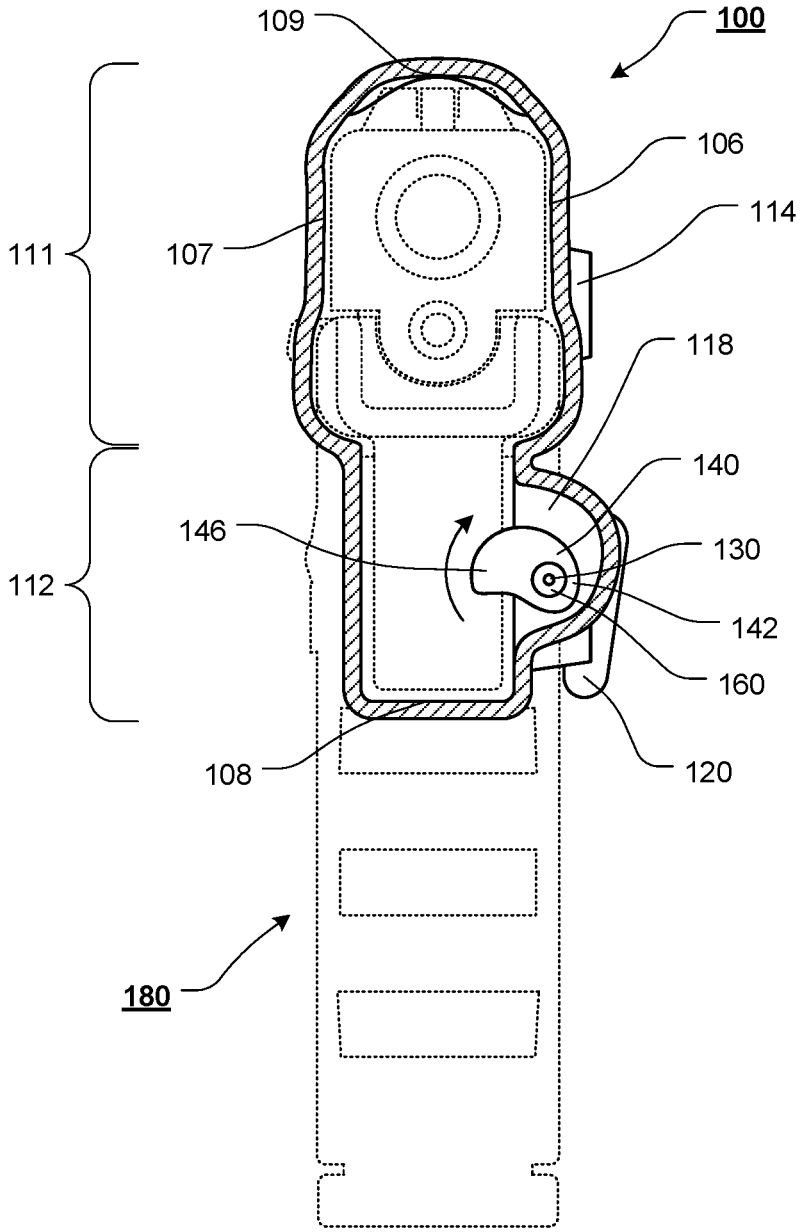
FIG. 6 illustrates a bottom, cross-sectional view, taken along line 6-6 of FIG. 1, of an exemplary embodiment of a holster, wherein an exemplary handgun is partially inserted within the holster, according to the presently disclosed systems, methods, and/or apparatuses.

As the handgun 180 is inserted further into the at least partial cavity portion 105, at least a portion of the trigger guard 186 will slide adjacent or against the holster trigger guard portion 112 and a portion of the outer surface 187 of the trigger guard 186 will contact the first helical portion 145 and/or the first helical ramp surface 144 of the locking element 140 proximate or at the proximal end 141 of the locking element 140, as illustrated in FIGS. 5 and 6. The shape of the first helical portion 145 and/or the first helical ramp surface 144 allows at least a portion of the first helical portion 145 to ride along the surface of the trigger guard 186 and apply a rotational force to rotate the locking element 140, about the rotation pin 130, toward the disengaged position.

Figure 7:
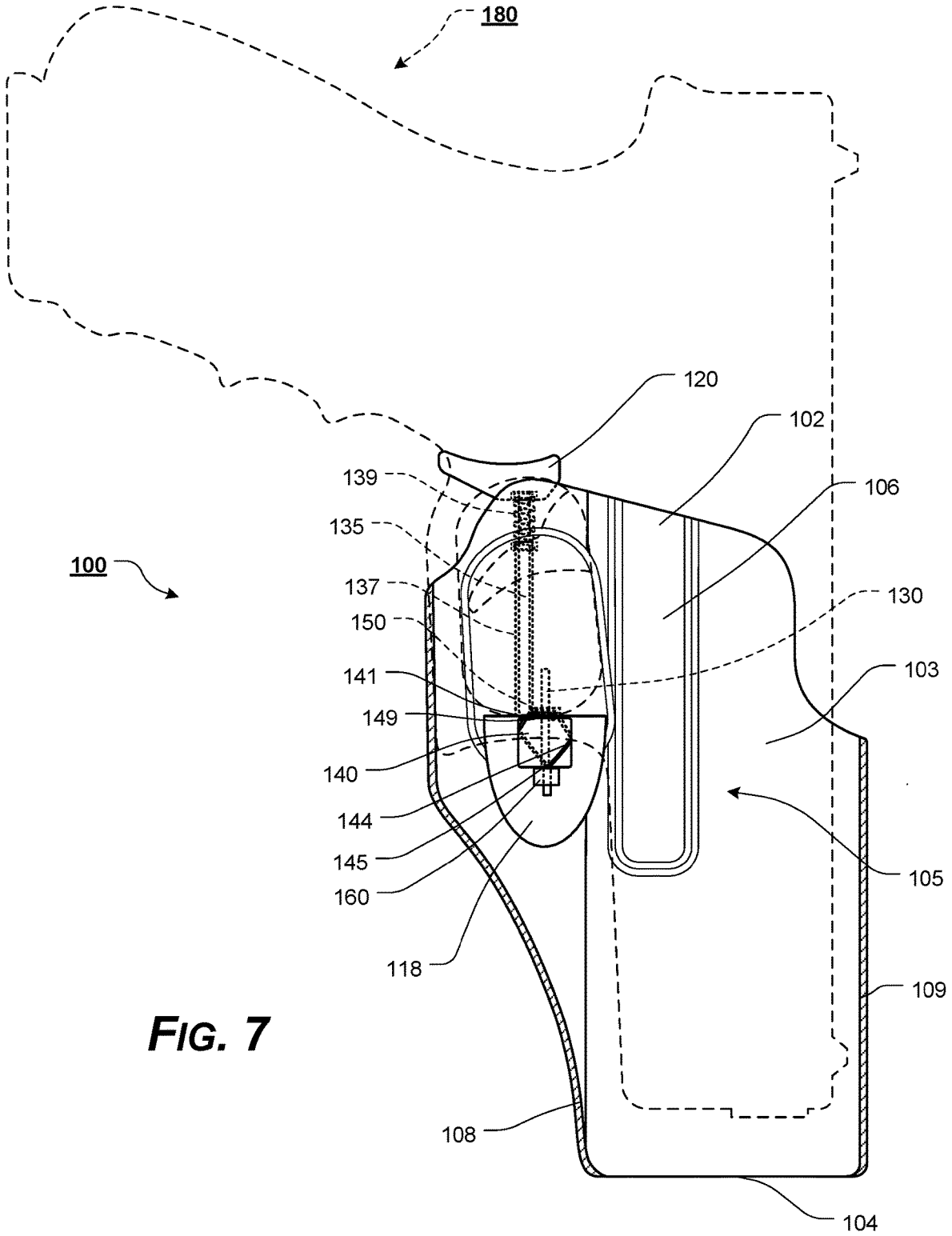
FIG. 7 illustrates a right side, cross-sectional view of an exemplary embodiment of a holster, wherein an exemplary handgun is further partially inserted within the holster, according to the presently disclosed systems, methods, and/or apparatuses.

As the first helical portion 145 continues to ride along the surface of the trigger guard 186, the bias of the locking element 140 is overcome and the locking element 140 is rotated toward the disengaged position, as illustrated in FIG. 7, and the handgun 180 is permitted to be seated in the at least partial cavity portion 105 of the holster 100. The trigger guard 186 is prevented from moving in a direction opposite the locking projection portion 146 by the interior surfaces of the holster 100.

Figure 8:
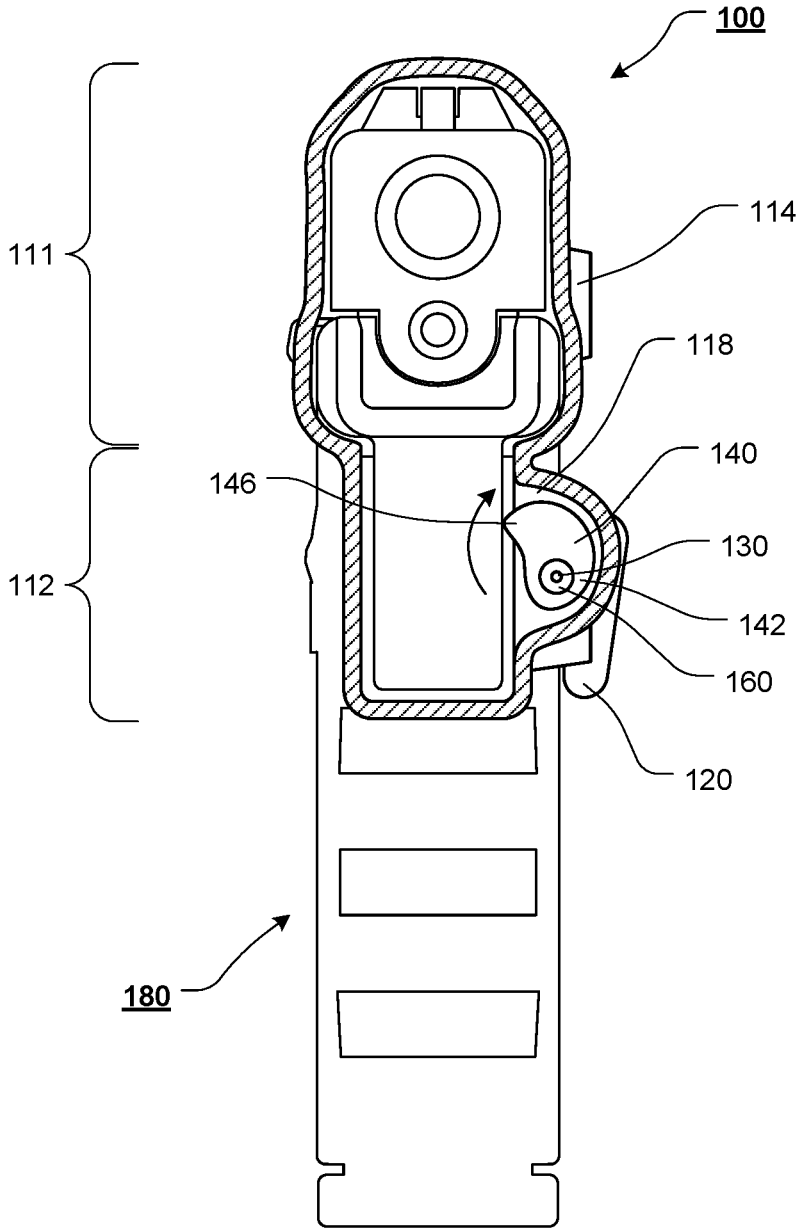
FIG. 8 illustrates a bottom, cross-sectional view, taken along line 6-6 of FIG. 1, of an exemplary embodiment of a holster, wherein an exemplary handgun is further partially inserted within the holster, according to the presently disclosed systems, methods, and/or apparatuses.

As the handgun 180 is further seated into the holster 100, the trigger guard 186 continues to travel from the proximal end 141 of the locking element 140 toward the distal end 142 of the locking element 140, the trigger guard 186 continues to displace the first helical portion 145 of the locking projection portion 146 and the locking element 140 continues to rotate, as illustrated in FIG. 8, until the trigger guard 186 passes a point of contact with a farthest extent of the locking projection portion 146 and clears the distal end 142 of the locking element 140.

Figure 9:
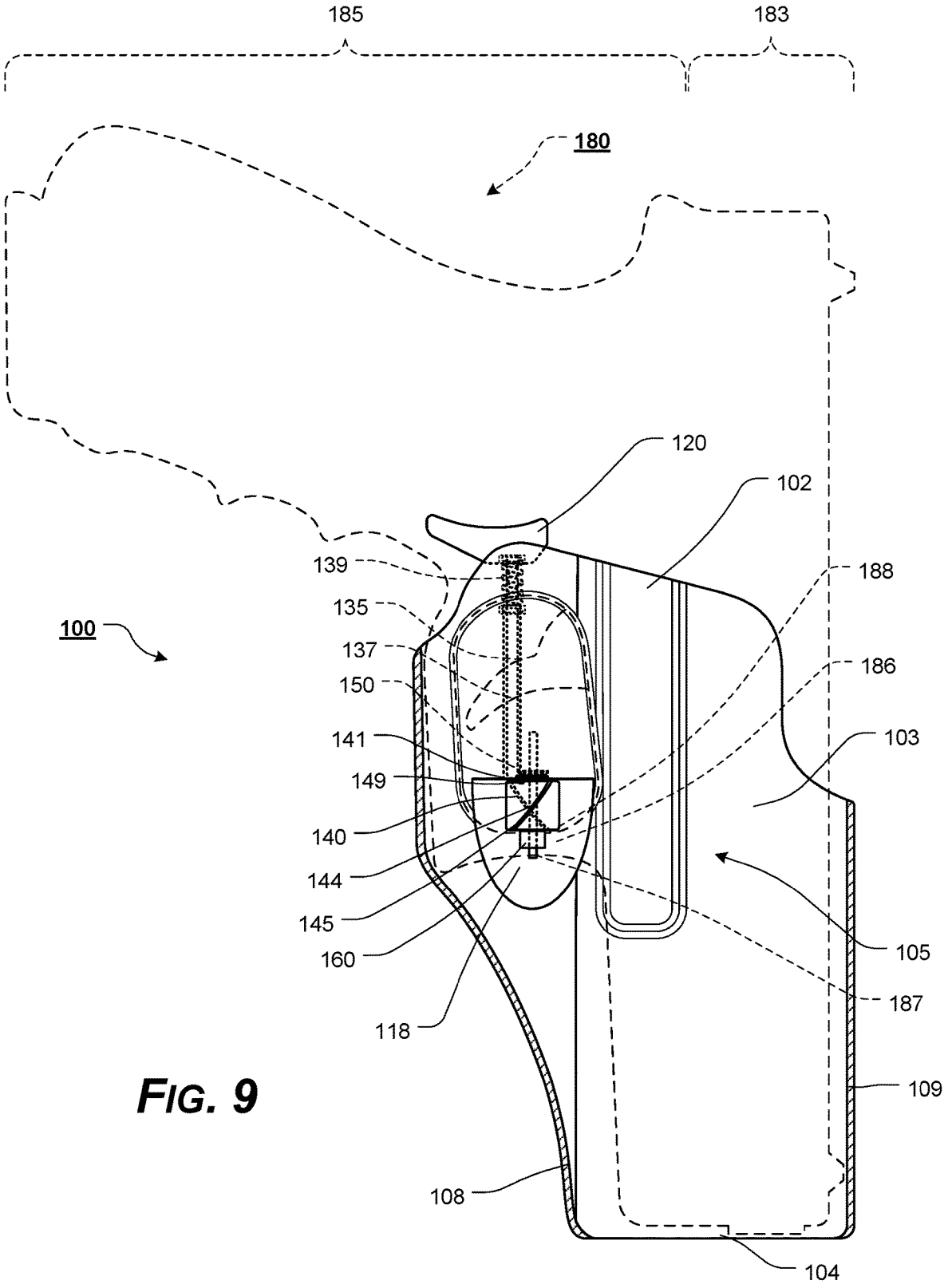
FIG. 9 illustrates a right side, cross-sectional view of an exemplary embodiment of a holster, wherein an exemplary handgun is seated within the holster, according to the presently disclosed systems, methods, and/or apparatuses.
Figure 10:
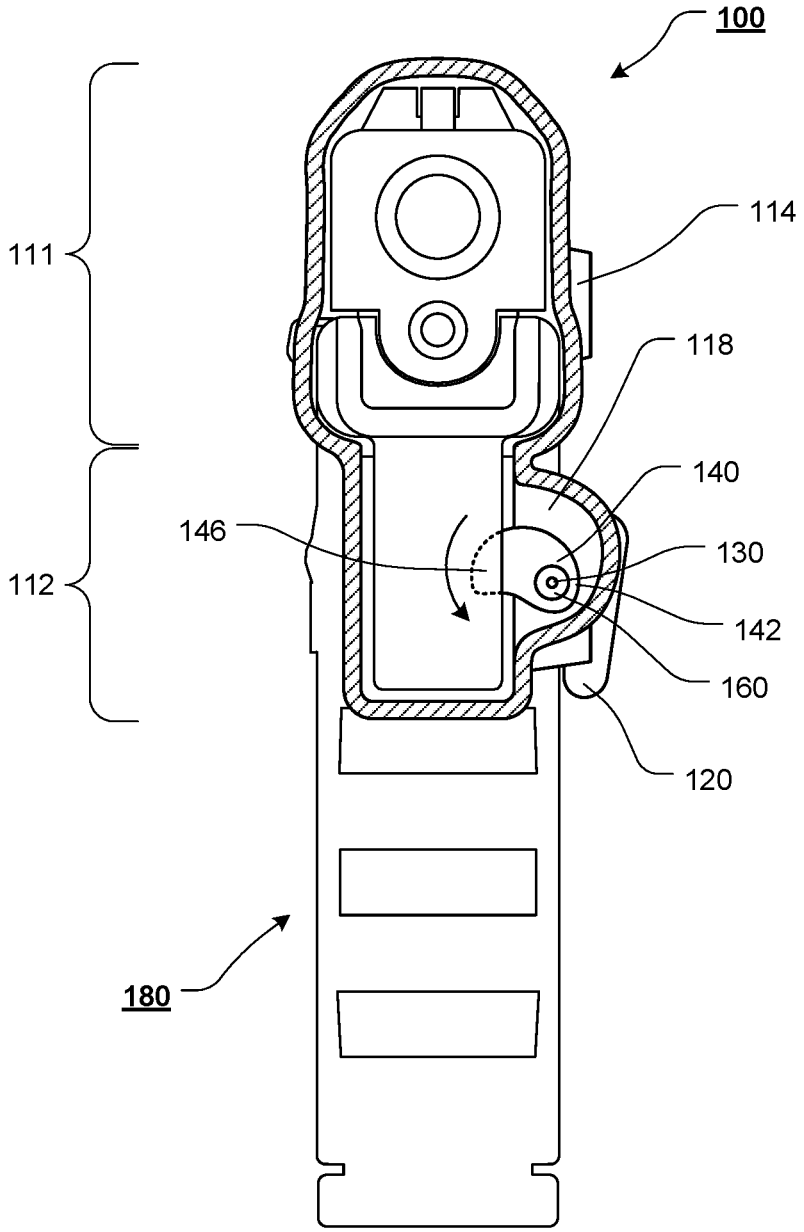
FIG. 10 illustrates a bottom, cross-sectional view, taken along line 6-6 of FIG. 1, of an exemplary embodiment of a holster, wherein an exemplary handgun is seated within the holster, according to the presently disclosed systems, methods, and/or apparatuses.
Figure 11:
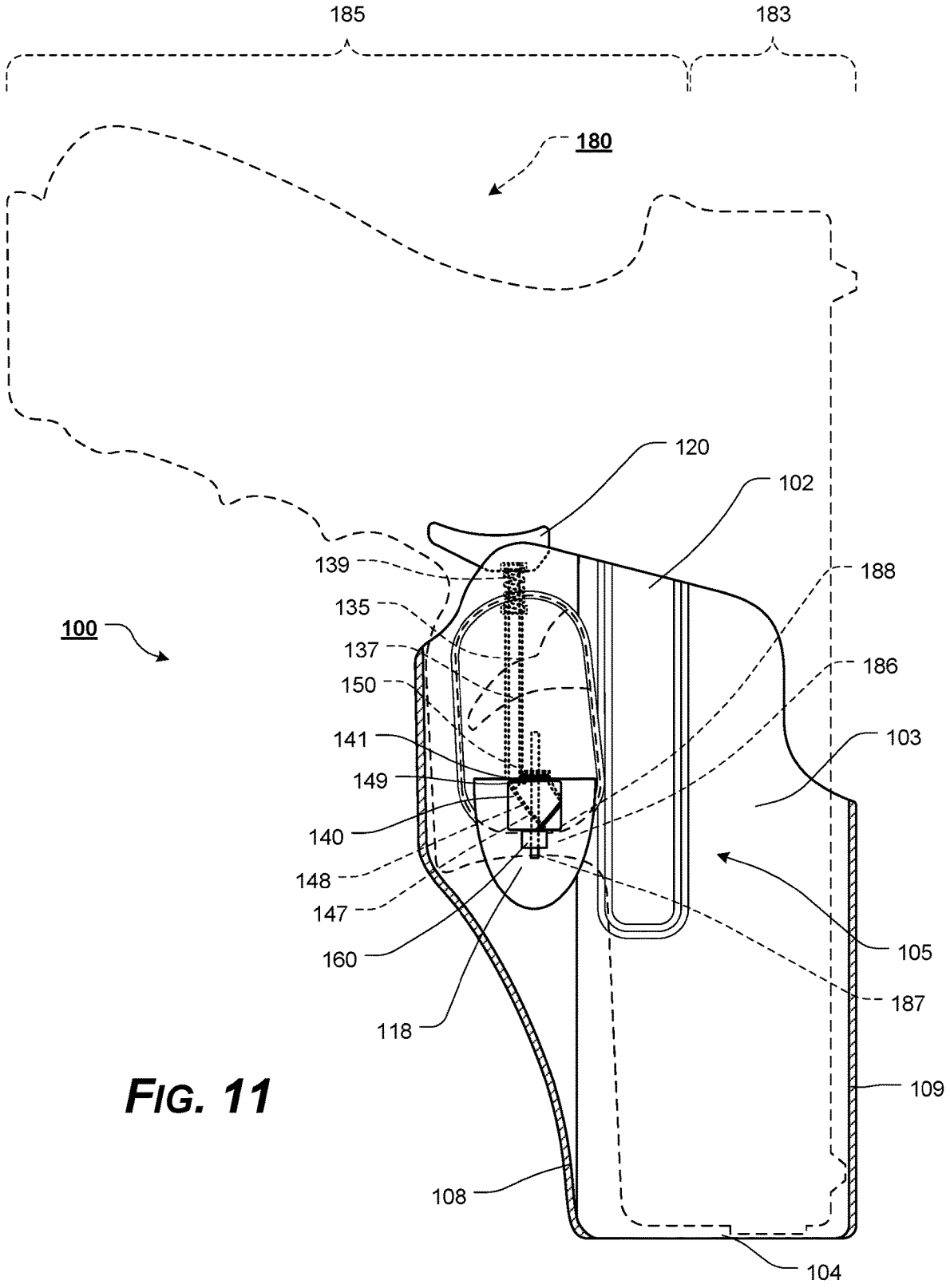
FIG. 11 illustrates a right side, cross-sectional view of an exemplary embodiment of a holster, wherein an exemplary handgun is seated within the holster and the locking element is rotated towards an unlocked position, according to the presently disclosed systems, methods, and/or apparatuses.

When the trigger guard 186 passes the locking projection portion 146, the locking element 140 may be biased, via the locking element biasing element 150, to rotate the locking element 140 back to the engaged position, as illustrated in FIGS. 9 and 10.

Thus, the locking element 140 is rotated to the disengaged position as the outer surface of the trigger guard 186 contacts the first helical portion 145 of the locking element 140 and is automatically rotated to the engaged position, via the locking element biasing element 150, when the inner surface 188 of the trigger guard 186 has passed the locking projection portion 146.

When the locking element 140 is rotated back to the engaged position, the locking projection portion 146 extends such that at least a portion of the distal end 142 of the locking element 140 contacts the inner surface 188 of the trigger guard 186 and resists or blocks rearward movement of the handgun 180 if a removal force is applied to the handgun 180. In this manner, the handgun 180 is secured in the at least partial cavity portion 105 of the holster 100 by operation of the at least a portion of the distal end 142 of the locking element 140 blocking removal of the handgun 180, by contacting the inner surface 188 of the trigger guard 186. Thus, the trigger guard 186 is prevented from moving in a direction opposite the locking projection portion 146 by the interior surfaces of the holster 100.

While the handgun 180 is fully seated in the at least partial cavity portion 105 of the holster 100 with the locking element 140 biased to the engaged position, removal of the handgun 180 is not permitted, as the locking projection portion 146 does not allow the trigger guard 186 to pass by. When the handgun 180 is secured in place, removal force applied to the handgun 180 will not remove the handgun 180 from the holster 100 unless the release lever 120 is urged downward and the locking projection portion 146 is brought out of the way of the inner surface 188 of the trigger guard 186.

In order to release and unholster the handgun 180, the release lever 120 is urged toward the disengaged position (typically by applying a force to the release lever 120 sufficient to overcome the biasing force of the release lever biasing element 139), by urging the release lever 120 towards the locking element 140. As the release lever 120 is urged downward, toward the locking element 140, the first end of the pushrod 135 contacts the second helical portion 147 and/or the second helical ramp surface 148. As the release lever 120 (and the pushrod 135) continue to be urged toward the locking element 140, interaction between the first end of the pushrod 135 and the second helical ramp surface 148 of the second helical portion 147 causes the locking element 140 to rotate, about the rotation pin 130.

At some point, as the release lever 120 is further urged toward the disengaged position, the bias of the locking element 140 is overcome, the release lever 120 is rotated towards the disengaged position, and the locking projection portion 146 of the locking projection portion 146 is at least partially withdrawn from the interior of the trigger guard 186.

When the release lever 120 has been rotated sufficiently, such that the locking projection portion 146 of the locking element 140 is sufficiently withdrawn, the locking projection portion 146 clears the inner surface 188 of the trigger guard 186, the trigger guard 186 will no longer be blocked by the locking projection portion 146, and the handgun 180 can be withdrawn from the holster 100, as illustrated in FIG. 12.

The holster 100, as shown and described with reference to FIGS. 1-12, is oriented such that the release lever 120 is generally accessible by the user's thumb. However, in various other exemplary embodiments, the release lever 120 may optionally be positioned so that it is generally accessible by one or more of the user's other fingers.

It should be appreciated that the holster 100 is generally illustrated as being a right-hand holster. However, the structure and/or elements of the holster 100 may be positioned so as to provide a left-hand holster.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A holster, comprising:

a holster body defining an at least partial cavity portion capable of receiving at least a portion of a handgun therein;

a locking element, wherein said locking element extends from a proximal end to a distal end, wherein a first helical portion, defining a first helical ramp surface, begins at or proximate said proximal end and extends to a locking projection portion extending from at least a portion of said distal end of said locking element, wherein a second helical portion, defining a second helical ramp surface, begins at or proximate said proximal end and extends toward said distal end of said locking element, wherein said locking element is at least partially rotatable between a locking element engaged position and a locking element disengaged position, wherein at least a portion of said locking element retains said handgun in said holster in said locking element engaged position, via interaction between at least a portion of said locking projection portion and an interior surface of a trigger guard of said handgun, and permits release of said handgun when in said locking element disengaged position;

an elongate pushrod, extending from a first end to a second end, wherein at least a portion of said pushrod is slidably positioned within at least a portion of said holster body, such that at least said first end of said pushrod may be urged within said at least partial cavity portion to contact said second helical ramp surface of said second helical portion of said locking element such that if said pushrod is urged toward said locking element, interaction between said first end of said pushrod and said second helical ramp surface of said second helical portion causes said locking element to rotate toward the locking element disengaged position; and a release lever attached or coupled to said second end of said pushrod.

2. The holster of claim 1, wherein said holster body comprises a pair of opposed wall portions comprising a first wall portion and a second wall portion and a pair of opposed wall portions comprising a third wall portion and a fourth wall portion.

3. The holster of claim 1, wherein said second helical portion comprises a multipart or multi-ramped surface.

4. The holster of claim 1, wherein said first helical ramp surface is a helical recess or a helical protrusion.

5. The holster of claim 1, wherein said first helical ramp surface is formed in or around at least a portion of said locking element.

6. The holster of claim 1, wherein said first helical ramp surface provides an incurved rim that curves around at least a portion of said locking element.

7. The holster of claim 1, wherein said first helical ramp surface generally follows a spiral or a curve along a portion of said locking element.

8. The holster of claim 1, wherein said second helical ramp surface is a helical recess or a helical protrusion.

9. The holster of claim 1, wherein said second helical ramp surface provides an incurved rim that curves around at least a portion of said locking element.

10. The holster of claim 1, wherein said second helical ramp surface generally follows a spiral or a curve along a portion of said locking element.

11. The holster of claim 1, wherein at least a portion of said pushrod is positioned within a portion of a pushrod channel formed in or through at least a portion of said holster body.

12. The holster of claim 1, wherein at least a portion of said locking element retains said handgun in said holster in said locking element engaged position, via interaction between at least a portion of said locking projection portion and an interior surface of a trigger guard of said handgun and permits release of said handgun when in said locking element disengaged position.

13. The holster of claim 1, wherein in said locking element engaged position at least a portion of said locking projection portion of said locking element protrudes into said at least partial cavity portion a sufficient distance to extend inside at least a portion of a trigger guard of said handgun if said handgun is seated within said at least partial cavity portion of said holster, wherein in said locking element disengaged position at least a portion of said locking projection portion of said locking element is withdrawn from said at least partial cavity portion a sufficient distance to be withdrawn from said trigger guard of said handgun if said handgun is seated within said at least partial cavity portion of said holster and permit release of said handgun when in said locking element disengaged position.

14. The holster of claim 1, wherein in said locking element engaged position at least a portion of said locking projection portion of said locking element protrudes into said at least partial cavity portion a sufficient distance to extend inside at least a portion of a trigger guard of said handgun if said handgun is seated within said at least partial cavity portion of said holster, wherein in said locking element disengaged position at least a portion of said locking projection portion of said locking element is withdrawn from said at least partial cavity portion a sufficient distance to be withdrawn from said trigger guard of said handgun.

15. The holster of claim 1, wherein if said locking element is in said engaged position, at least a portion of said locking projection portion of said locking element protrudes into said at least partial cavity portion a sufficient distance to extend inside at least a portion of said trigger guard of said handgun if said handgun is seated within said at least partial cavity portion of said holster.

16. The holster of claim 1, wherein said locking element is biased to said locking element engaged position and said release lever is biased to said release lever engaged position.

17. The holster of claim 1, wherein said release lever is accessible by a user's thumb.

18. The holster of claim 1, wherein said release lever is accessible by at least one of a user's fingers.

19. A holster for a handgun, comprising:

a holster body defining an at least partial cavity portion capable of receiving at least a portion of said handgun therein;

a locking element, wherein said locking element extends from a proximal end to a distal end, wherein a first helical portion, defining a first helical ramp surface, begins at or proximate said proximal end and extends to a locking projection portion extending from at least a portion of said distal end of said locking element, wherein a second helical portion, defining a second helical ramp surface, begins at or proximate said proximal end and extends toward said distal end of said locking element, wherein said locking element is at least partially rotatable between a locking element engaged position and a locking element disengaged position, wherein in said locking element engaged position at least a portion of said locking projection portion of said locking element protrudes into said at least partial cavity portion, wherein in said locking element disengaged position at least a portion of said locking projection portion of said locking element is withdrawn from said at least partial cavity portion;

an elongate pushrod, wherein at least a portion of said pushrod is slidably positioned within at least a portion of said holster body, wherein if said pushrod is urged toward said locking element, interaction between a first end of said pushrod and said second helical ramp surface of said second helical portion causes said locking element to rotate toward the locking element disengaged position.

20. A holster for a handgun, comprising:

a holster body defining an at least partial cavity portion capable of receiving at least a portion of said handgun therein;

a locking element, wherein said locking element extends from a proximal end to a distal end, wherein a first helical portion, defining a first helical ramp surface, begins at or proximate said proximal end and extends to a locking projection portion extending from at least a portion of said distal end of said locking element, wherein a second helical portion, defining a second helical ramp surface, begins at or proximate said proximal end and extends toward said distal end of said locking element, wherein said locking element is at least partially rotatable between a locking element engaged position and a locking element disengaged position, wherein in said locking element engaged position at least a portion of said locking projection portion of said locking element protrudes into said at least partial cavity portion, wherein in said locking element disengaged position at least a portion of said locking projection portion of said locking element is withdrawn from said at least partial cavity portion;

an elongate pushrod, wherein at least a portion of said pushrod is slidably positioned within at least a portion of said holster body, wherein if said pushrod is urged toward said locking element, interaction between a first end of said pushrod and said second helical ramp surface of said second helical portion causes said locking element to rotate toward the locking element disengaged position; and a release lever attached or coupled to a second end of said pushrod.

* * * * *